US008777011B2

(12) United States Patent
Cheu et al.

(10) Patent No.: US 8,777,011 B2
(45) Date of Patent: Jul. 15, 2014

(54) CAPSULE PACKAGE WITH MOISTURE BARRIER

(75) Inventors: Scot Cheu, San Jose, CA (US); William Leung, Redwood City, CA (US); Mei-Chang Kuo, Palo Alto, CA (US); Andrew Clark, Woodside, CA (US)

(73) Assignee: Novartis AG, Basel (CH)

( * ) Notice: Subject to any disclaimer, the term of this patent is extended or adjusted under 35 U.S.C. 154(b) by 606 days.

(21) Appl. No.: 10/313,419

(22) Filed: Dec. 6, 2002

(65) Prior Publication Data

US 2003/0106827 A1 Jun. 12, 2003

Related U.S. Application Data

(60) Provisional application No. 60/343,309, filed on Dec. 21, 2001.

(51) Int. Cl.
*B65D 83/04* (2006.01)

(52) U.S. Cl.
USPC ..... 206/530; 206/531

(58) Field of Classification Search
USPC ..... 206/438, 439, 528, 529, 530, 531, 532, 206/534.1, 538
See application file for complete search history.

(56) References Cited

U.S. PATENT DOCUMENTS

| | | | | |
|---|---|---|---|---|
| 3,072,528 | A * | 1/1963 | Schieferdecker et al. | 424/451 |
| 3,630,346 | A | 12/1971 | Burnside | |
| 3,938,659 | A | 2/1976 | Wardwell | |
| 3,991,761 | A | 11/1976 | Cocozza | |
| 4,137,914 | A | 2/1979 | Wetterlin | |
| 4,190,154 | A | 2/1980 | Clark | |
| 4,206,844 | A | 6/1980 | Thukamoto et al. | |
| 4,372,098 | A * | 2/1983 | Mason | 53/412 |
| 4,429,792 | A | 2/1984 | Machbitz | |
| 4,567,986 | A * | 2/1986 | Eastwood | 206/532 |
| 4,827,307 | A | 5/1989 | Zoltner | |
| 4,911,304 | A * | 3/1990 | Bunin | 206/531 |
| 4,995,385 | A | 2/1991 | Valentini et al. | |
| 5,011,019 | A * | 4/1991 | Satoh et al. | 206/530 |
| 5,088,603 | A * | 2/1992 | Kirkpatrick | 206/530 |
| 5,268,209 | A | 12/1993 | Hunt et al. | |
| 5,458,135 | A | 10/1995 | Patton et al. | |
| 5,560,490 | A | 10/1996 | Chawla | |

(Continued)

FOREIGN PATENT DOCUMENTS

| | | |
|---|---|---|
| DE | 1486399 A | 4/1969 |
| GB | 2 354 513 | 3/2001 |

(Continued)

OTHER PUBLICATIONS

U.S. Appl. No. 09/556,262, filed Apr. 24, 2000, Schuler et al.

(Continued)

*Primary Examiner* — John Ricci
(74) *Attorney, Agent, or Firm* — Janah & Associates, PC

(57) ABSTRACT

A package for storing an aerosolizable pharmaceutical formulation comprises a capsule adapted to contain the aerosolizable pharmaceutical formulation, and a moisture barrier around the capsule. The moisture barrier comprises a material that is resistant to moisture passage, whereby the moisture barrier reduces the amount of moisture in contact with the aerosolizable pharmaceutical formulation so that the aerosolizable pharmaceutical formulation may be aerosolized when the capsule is opened. In one version, the moisture barrier comprises a metal.

19 Claims, 8 Drawing Sheets

(56) References Cited

U.S. PATENT DOCUMENTS

| | | | | |
|---|---|---|---|---|
| 5,622,028 | A | | 4/1997 | Harp |
| 5,626,871 | A | | 5/1997 | Makino et al. |
| 5,785,049 | A | | 7/1998 | Smith et al. |
| 5,861,915 | A | | 1/1999 | Sato et al. |
| 5,862,915 | A | | 1/1999 | Plezia et al. |
| 5,883,088 | A | * | 3/1999 | Bernstein ..... 514/184 |
| 5,922,675 | A | | 7/1999 | Baker et al. |
| 5,939,394 | A | * | 8/1999 | Fleming et al. ..... 514/23 |
| 5,957,317 | A | | 9/1999 | Lee |
| 5,985,309 | A | | 11/1999 | Edwards et al. |
| 6,031,153 | A | | 2/2000 | Ryals et al. |
| 6,174,860 | B1 | | 1/2001 | Kramer et al. |
| 6,230,707 | B1 | | 5/2001 | Hörlin |
| 6,257,233 | B1 | | 7/2001 | Burr et al. |
| 6,309,623 | B1 | | 10/2001 | Weers et al. |
| 6,433,040 | B1 | | 8/2002 | Dellamary et al. |
| 6,546,929 | B2 | | 4/2003 | Burr et al. |
| 6,565,885 | B1 | | 5/2003 | Tarara et al. |
| 6,606,992 | B1 | | 8/2003 | Schuler et al. |
| 6,630,169 | B1 | | 10/2003 | Bot et al. |
| 6,638,495 | B2 | | 10/2003 | Weers et al. |
| 6,941,980 | B2 | | 9/2005 | Rocchio et al. |
| 6,946,117 | B1 | | 9/2005 | Schutt et al. |
| 7,141,236 | B2 | | 11/2006 | Bot et al. |
| 7,205,343 | B2 | | 4/2007 | Dellamary et al. |
| 7,306,787 | B2 | | 12/2007 | Tarara et al. |
| 7,326,691 | B2 | | 2/2008 | Duddu et al. |
| 7,368,102 | B2 | | 5/2008 | Tarara et al. |
| 7,393,544 | B2 | | 7/2008 | Dellamary et al. |
| 7,442,388 | B2 | | 10/2008 | Weers et al. |
| 7,628,978 | B2 | | 12/2009 | Weers et al. |
| 2002/0017295 | A1 | | 2/2002 | Weers et al. |
| 2002/0106368 | A1 | | 8/2002 | Bot et al. |
| 2002/0187106 | A1 | | 12/2002 | Weers et al. |
| 2003/0003057 | A1 | | 1/2003 | Weers et al. |
| 2004/0060265 | A1 | | 4/2004 | Boeckle et al. |
| 2004/0105820 | A1 | | 6/2004 | Weers et al. |
| 2005/0051453 | A1 | | 3/2005 | Schuler et al. |
| 2005/0074449 | A1 | | 4/2005 | Bot et al. |
| 2005/0074498 | A1 | | 4/2005 | Tarara et al. |
| 2005/0150491 | A1 | | 7/2005 | Chen |
| 2005/0207986 | A1 | | 9/2005 | Schutt et al. |
| 2006/0159629 | A1 | | 7/2006 | Tarara et al. |
| 2006/0165606 | A1 | | 7/2006 | Tarara et al. |
| 2007/0065369 | A1 | | 3/2007 | Bot et al. |
| 2008/0063606 | A1 | | 3/2008 | Tarara et al. |
| 2008/0226564 | A1 | | 9/2008 | Weers et al. |

FOREIGN PATENT DOCUMENTS

| | | | |
|---|---|---|---|
| WO | 95/01920 | | 1/1995 |
| WO | 95/24183 | | 9/1995 |
| WO | 96/32096 | | 10/1996 |
| WO | 96/32149 | | 10/1996 |
| WO | 97/27892 | | 8/1997 |
| WO | WO9826082 | | 6/1998 |
| WO | WO9829537 | | 7/1998 |
| WO | WO9905286 | | 2/1999 |
| WO | 99/16419 | | 4/1999 |
| WO | 99/16422 | | 4/1999 |
| WO | WO9916420 | | 4/1999 |
| WO | WO9916421 | | 4/1999 |
| WO | WO9942589 | | 8/1999 |
| WO | WO9954472 | | 10/1999 |
| WO | WO0000215 | | 1/2000 |
| WO | WO0005078 | | 2/2000 |
| WO | WO0053762 | | 9/2000 |
| WO | 00/72904 | | 12/2000 |
| WO | WO 01/21503 | A1 | 3/2001 |
| WO | WO0185136 | | 11/2001 |
| WO | WO0185137 | | 11/2001 |
| WO | WO 02/09674 | | 2/2002 |
| WO | WO 02/008322 | | 10/2002 |
| WO | WO03057564 | | 7/2003 |
| WO | WO03057593 | | 7/2003 |
| WO | WO2004002827 | | 1/2004 |
| WO | WO2004032920 | | 4/2004 |

OTHER PUBLICATIONS

Pilchik, Ron, "Pharmaceutical Blister Packaging, Part I, Rationale and Materials," Pharmaceutical Technology, Nov. 2000, pp. 68-76.
Pilchik, Ron, "Pharmaceutical Blister Packaging, Part II, Machinery and Assembly," Pharmaceutical Technology, Dec. 2000, pp. 56-60.

* cited by examiner

CAPSULE PACKAGE WITH MOISTURE BARRIER

RELATED APPLICATIONS

The present application claims the benefit of U.S. Provisional Application No. 60/343,309, filed on Dec. 21, 2001, which is incorporated herein by reference in its entirety.

BACKGROUND

The need for effective therapeutic treatment of patients has resulted in the development of a variety of pharmaceutical formulation delivery techniques. One traditional technique involves the oral delivery of a pharmaceutical formulation in the form of a pill, capsule, elixir, or the like. However, oral delivery can in some cases be undesirable. For example, many pharmaceutical formulations may be degraded in the digestive tract before they can be effectively absorbed by the body. Inhaleable drug delivery, where an aerosolized pharmaceutical formulation is orally or nasally inhaled by a patient to deliver the formulation to the patient's respiratory tract, has proven to be a particularly effective and/or desirable alternative. For example, in one inhalation technique, a pharmaceutical formulation is delivered deep within a patient's lungs where it may be absorbed into the blood stream. Many types of inhalation devices exist including devices that aerosolize a dry powder, devices comprising a pharmaceutical formulation stored in or with a propellant, devices which use a compressed gas to aerosolize a liquid pharmaceutical formulation, and similar devices.

In one dry powder aerosolization technique, a capsule containing an inhaleable dry powder is loaded into a chamber in an aerosolization device. Within the chamber, the dry powder is at least partially emptied and dispersed to aerosolize the dry powder so that it may be inhaled by a patient. However, in conventional devices, there may be inconsistent aerosolization of the dry powder for some pharmaceutical formulations. As a result, the therapeutic effects of the pharmaceutical formulation may less than ideal.

Therefore, it is desirable to be able to provide a powdered pharmaceutical formulation stored in a capsule that is consistently aerosolizable. It is further desirable to prevent degradation of a pharmaceutical formulation stored in a capsule.

SUMMARY

The present invention satisfies these needs. In one aspect of the invention, a package is provided for storing a capsule which contains an aerosolizable pharmaceutical formulation. The package includes a moisture barrier around the capsule to improve the aerosolization of the pharmaceutical formulation.

In another aspect of the invention, a package for storing an aerosolizable pharmaceutical formulation comprises a capsule adapted to contain the aerosolizable pharmaceutical formulation; and a moisture barrier around the capsule, the moisture barrier comprising a material that is resistant to moisture passage, whereby the moisture barrier reduces the amount of moisture in contact with the aerosolizable pharmaceutical formulation so that the aerosolizable pharmaceutical formulation may be aerosolized when the capsule is opened.

In another aspect of the invention, a package for storing an aerosolizable pharmaceutical formulation comprises a capsule adapted to contain the aerosolizable pharmaceutical formulation, and a bottle adapted to contain a plurality of capsules, the bottle comprising an evacuating mechanism, whereby the bottle reduces the amount of moisture in contact with the aerosolizable pharmaceutical formulation so that the aerosolizable pharmaceutical formulation may be aerosolized when the capsule is opened.

In another aspect of the invention, a package for storing a pharmaceutical formulation comprises a capsule adapted to contain the pharmaceutical formulation, wherein a wall of the capsule comprises a metal, whereby the wall reduces the amount of moisture in contact with the pharmaceutical formulation.

In another aspect of the invention, a package for storing a aerosolizable pharmaceutical formulation comprises a capsule adapted to contain the aerosolizable pharmaceutical formulation, and a multi-layered package around the capsule, the multi-layered package comprising an upper layer and a lower layer, wherein the upper layer and the lower layer each comprise a metal, whereby the multi-layered package reduces the amount of moisture in contact with the aerosolizable pharmaceutical formulation so that the aerosolizable pharmaceutical formulation may be aerosolized when the capsule is opened.

In another aspect of the invention, a method of storing a aerosolizable pharmaceutical formulation comprises containing the aerosolizable pharmaceutical formulation within a capsule, and surrounding the capsule with a moisture barrier to reduce the amount of moisture in contact with the aerosolizable pharmaceutical formulation so that the aerosolizable pharmaceutical formulation may be aerosolized when the capsule is opened.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to storing a pharmaceutical formulation. Although the process is illustrated in the context of storing a dry powder pharmaceutical formulation in a capsule, the present invention can be used in other processes and should not be limited to the examples provided herein.

Figure 1:
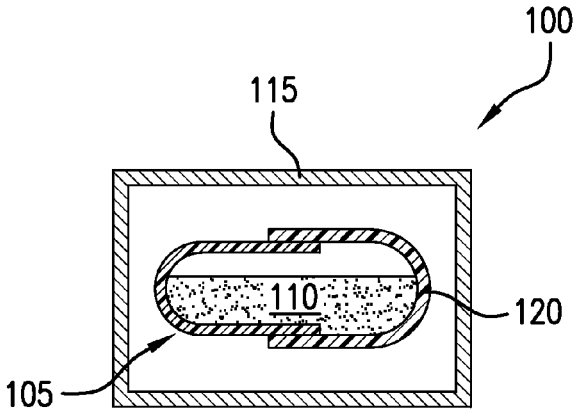
FIG. 1 is a schematic sectional side view of a package according to the present invention.

A package 100 according to the present invention is shown schematically in FIG. 1. The package 100 comprises a first container, such as a capsule 105, that is capable of being at least partially filled with a pharmaceutical formulation 110. The capsule 105 contains the pharmaceutical formulation 110 and provides the pharmaceutical formulation 110 with at least some protection against environmental conditions, such as moisture. In addition, the package 100 comprises an additional moisture barrier 115 that is adapted to provide further protection against undesirable amounts of moisture coming in contact with the pharmaceutical formulation 110.

Some pharmaceutical formulations are particularly sensitive to moisture. For example, some dry powder pharmaceutical formulations that are to be aerosolized and inhaled by a user may become agglomerated when in the presence of excessive moisture. The agglomerations may affect the aerosol characteristics of the pharmaceutical formulation and reduce the therapeutic effects of the pharmaceutical formulation delivery. Accordingly, the package 100 of the present invention may be adapted to provide sufficient moisture protection over a predetermined amount of time for a particular pharmaceutical formulation. For example, the moisture barrier 115 or the combination of the moisture barrier 115 with the capsule 105 may provide moisture protection for at least about 2 days, more preferably for at least about 1 week, and most preferably for at least about 3 weeks.

The capsule 105 may be of a suitable shape, size, and material to contain the pharmaceutical formulation 110 and to provide the pharmaceutical formulation 110 in a usable condition. For example, the capsule 105 may comprise a wall 120 which comprises a material that does not adversely react with the pharmaceutical formulation. In addition, the wall 120 may comprise a material that allows the capsule 105 to be opened to allow the pharmaceutical formulation 110 to be aerosolized. In one version, the wall 120 comprises one or more of gelatin, hydroxypropyl methylcellulose (HPMC), polyethyleneglycol-compounded HPMC, hydroxyproplycellulose, agar, or the like. Alternatively or additionally, the capsule wall 120 may comprise a polymeric material, such as polyvinyl chloride (PVC). In one version, the capsule 105 may comprise telescopically a joined sections, as described for example in U.S. Pat. No. 4,247,066 which is incorporated herein by reference in its entirety. The interior of the capsule 105 may be filled with a suitable amount of the pharmaceutical formulation 110, and the size of the capsule 105 may be selected to adequately contain a desired amount of the pharmaceutical formulation 110.

The moisture barrier 115 may be sufficiently thick to decrease the amount of moisture that is able to pass through the barrier 115. In one version, the moisture barrier 115 comprises a material that is resistant to moisture passage in order to reduce the thickness of the barrier 115. For example, the moisture barrier 115 may comprise one or more metals, such as aluminum or the like, and/or other moisture barrier materials, such as polyamides, polyvinyl chlorides and the like.

Figure 2A:
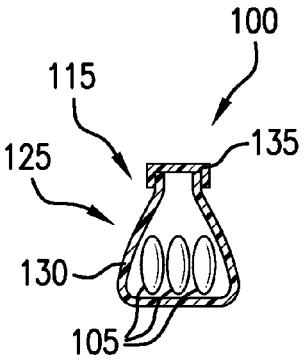
FIGS. 2A through 2C are schematic sectional side views of versions of packages comprising a bottle.
Figure 2B:
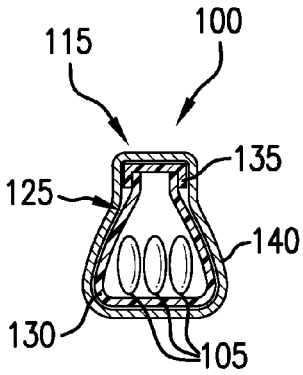
Figure 2C:
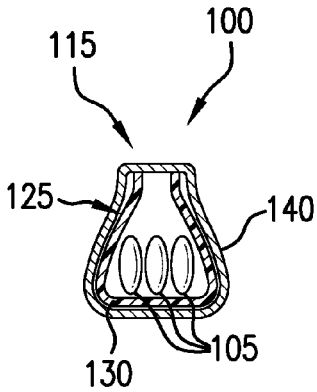

In one version, the moisture barrier 115 may comprise a bottle 125 that holds a single dose of an aerosolizable pharmaceutical formulation. For example, in the version shown in FIG. 2A, one or more capsules 105 containing an aerosolizable pharmaceutical formulation are inserted into the body 130 of the bottle 125 and a cap 135 is inserted thereonto. In one version, the bottle 135 is at least partially evacuated or at least a portion of the moisture is otherwise removed as the one or more capsules 105 are inserted. The dose of single dose of the aerosolizable pharmaceutical formulation may be made up of a particular number of capsules selected to deliver a predetermined amount of the pharmaceutical formulation in aerosolized form to a user. For example, as shown in FIG. 2A, the single dose may consist of three capsules 105. Alternatively, the single dose may consist of one, two, or any number of capsules 105. The cap 135 may be secured to the body 130 by threads, snap-fit, friction fit, or any suitable manner. Preferably the manner of attachment provides sufficient protection against the passage of moisture. To provide even further moisture protection, the moisture barrier 115 may comprise the bottle 125 and an additional layer of protection. For example, in the version shown in FIG. 2B, the moisture barrier 115 comprises a metal-containing layer 140 that surrounds the bottle 125. In one version, the metal containing layer 140 comprises a foil of aluminum that is heat shrunk around the bottle. The foil may be, for example, from about 10 μm to about 100 μm, and more preferably from about 20 μm to about 80 μm. The foil may also be provided with a manner of allowing the foil to be removed, such as tabbing, scoring, or the like. In another version, as shown in FIG. 2C, the cap 135 may be removed and the metal-containing layer 140 may serve as the covering to secure the one or more capsules 105 within the body 130 of the bottle 125.

Figure 3A:
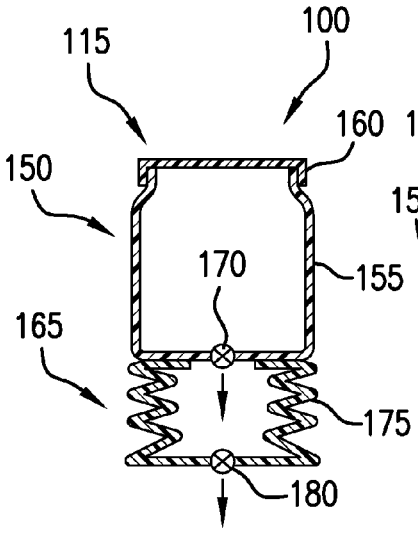
FIGS. 3A through 3C are schematic sectional side views of versions of packages comprising evacuatable bottles.
Figure 3B:
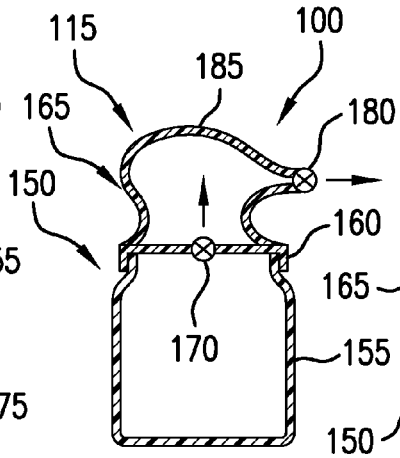
Figure 3C:
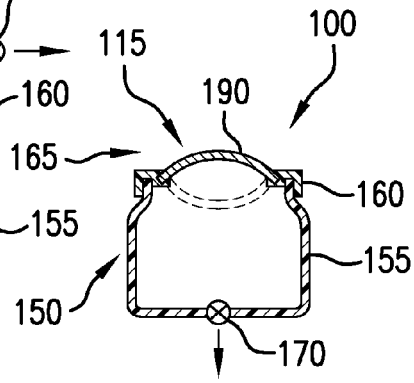

In another version, the moisture barrier 115 may comprise a bottle 150 that contains multiple doses of an aerosolizable pharmaceutical formulation. Unlike the versions of FIGS. 2A through 2C, a bottle 150 containing multiple doses of a pharmaceutical formulation may be opened and closed one or more times, and with each opening the capsules 105 within the bottle 150 are subjected to environmental conditions, including potentially undesirable amounts of moisture. Accordingly, in one version, the moisture barrier comprises a bottle 150 that is capable of reducing the effects of the environmental exposure. For example, in the version of FIG. 3A, the bottle 150 comprises a body 155 capable of containing multiple doses of capsules containing an aerosolizable pharmaceutical formulation and a cap 160 that is attachable to the body 155 in a suitable manner to secure the capsules 105 within the body 155. The bottle 150 also comprises an evacuation mechanism 165. In the version of FIG. 3A, the evacuation mechanism 165 comprises a one-way valve 170 on the body 155 that allows passage of air from within the body 155 to pass out of the body 155 but prevents the passage of air into the body 155. The evacuation mechanism 165 also comprises a bellows member 175 that has a one-way valve 180 that allows air to pass out of the bellows 175 but not into the bellows 175. After withdrawing a dose of pharmaceutical formulation, the user secures the cap 160 on the body and then compresses the bellows 175. Air within the bellows 175 is forced out through the one-way valve 180 on the bellows 175. The user then expands the bellows 175 or the bellows 175 is designed to automatically expand by the nature of its configuration. As a result of the expansion, air from the body 155 is pulled through the one-way valve 170 thereby at least partially evacuating the body 155 and removing some potentially undesirable moisture. FIG. 3B illustrates another version of an evacuation mechanism 165. In this version, the evacuation mechanism 165 comprises a squeezable bladder 185 that is normally biased into an expanded condition. Squeezing the bladder 185 forces air out the one-way valve 180 and the recovery of the bladder pulls air from the body 155 through the one way valve 170 to at least partially evacuate the body 155. As shown in the version of FIG. 3B, the evacuation mechanism 165 may be provided on the cap 160 to allow for use of a conventional body 155. Another version of an evacuation mechanism 165 is shown in FIG. 3C. In this version, the evacuation mechanism 165 comprises a bi-stable dome 190. By pressing on the dome 190, the dome takes on the shape shown by the dotted lines and forces air though the one-way valve 170. Afterwards, the dome 190 is returned to the position shown by the solid lines by a bias thereby at least partially evacuating the body 155 and at least partially reducing the amount of moisture within the body 155. In the versions of FIGS. 3A through 3C, the moisture protection may be further improved by providing a metal-containing layer around, within, or on the interior of the body 155 and/or the cap 160.

Figure 4A:
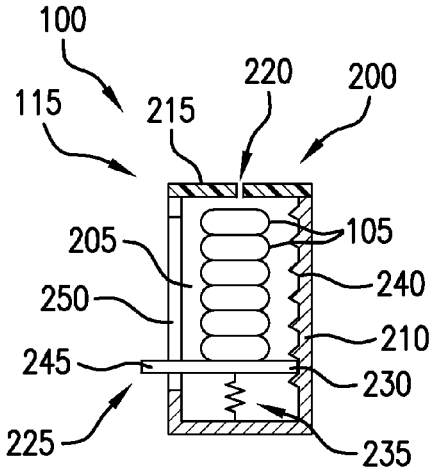
FIGS. 4A and 4B are schematic sectional side views of versions of packages that eject one or more capsules.
Figure 4B:
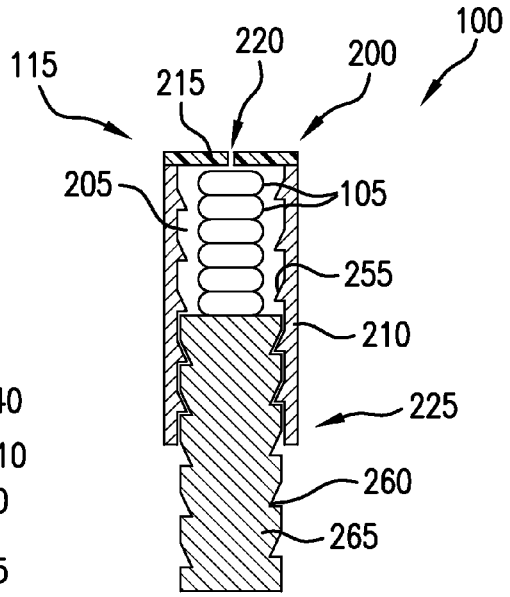

In another version, the moisture barrier 115 may comprise a container 200 that stores capsules 105 containing an aerosolizable pharmaceutical formulation in a reduced moisture environment and ejects a predetermined number of the capsules 105 while maintaining the reduced moisture environment. For example, as shown in FIG. 4A, a series of capsules 105 may be stored within an evacuated interior 205 of a cartridge 210. The cartridge 210 has an end that is covered by a flexible membrane 215 that has a slit 220 near its center. When the flexible membrane 215 is in the position shown in FIG. 4A, the slit 220 is closed and air is not allowed to pass through the slit 220. A capsule 105 is ejected from the cartridge 210 by an ejection mechanism 225. In the version of FIG. 4, the ejection mechanism 225 comprises a plate 230 that is forced into contact with the series of capsules 105 by a compressed spring 235. A series of notches 240 are provided within the cartridge 210 to prevent or inhibit movement of the plate 230. When the plate 230 is disengaged from a notch 240 the spring 235 forces the plate 230 toward the flexible membrane 215. As a result, the plate 230 presses on the series of capsules 105 and the topmost capsule is pressed against the flexible membrane 215 and pressed through the slit 220. The slit 220 slides around the capsule 105 being ejected and maintains contact with the capsule 105. In this way, the air is prevented from entering the interior 205 and the interior 205 maintains its reduced moisture condition. After ejection, the plate 230 nestles within the next notch 240. In the version shown, the plate 230 includes an extension portion 245 that sealingly extends through a slot 250. The extension portion 245 allows the user to advance the plate 230 from one notch 240 to the next, for example by pulling on the extension. Though the notches 140 are shown as being spaced so as to allow a single capsule 105 to be ejected, they may alternatively be spaced so that multiple capsules 105 may be ejected. Another version of an ejection mechanism 225 is shown in FIG. 4B. In this version, interior threads 255 are provided on the interior 205 of the cartridge 210. The interior threads 255 engage exterior threads 260 on a pushing member 265. Accordingly, as the pushing member 265 is rotated relative to the cartridge 210, the pushing member 265 advanced within the interior 205. Continued rotation will advance the pushing member 265 a sufficient amount to eject the topmost capsule 105 through the slit 215.

Figure 5A:
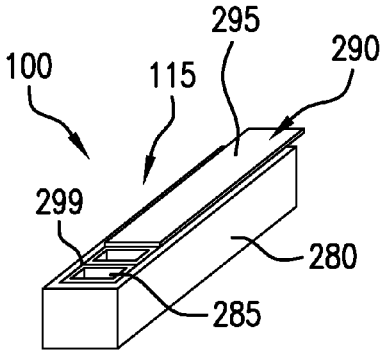
FIGS. 5A and 5B are schematic perspective views of versions of packages comprising a housing with compartments.
Figure 5B:
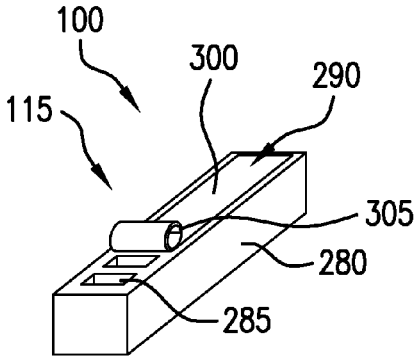
Figure 6A:
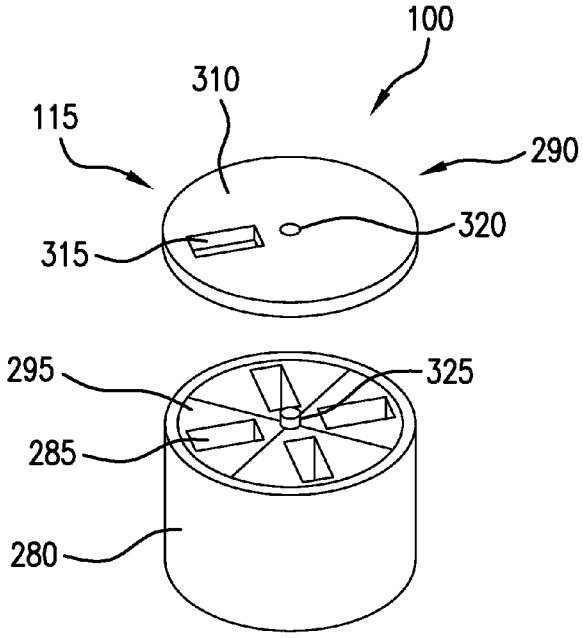
FIGS. 6A through 6C are schematic perspective views of rotary versions of packages comprising a housing with compartments.
Figure 6B:
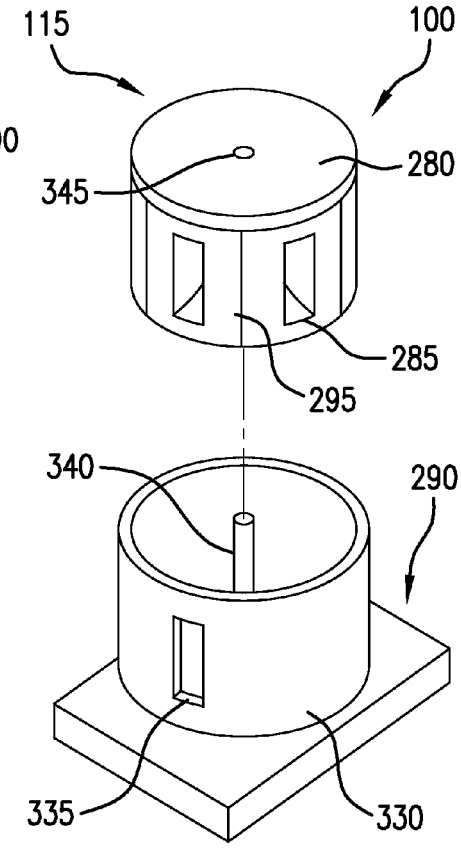
Figure 6C:
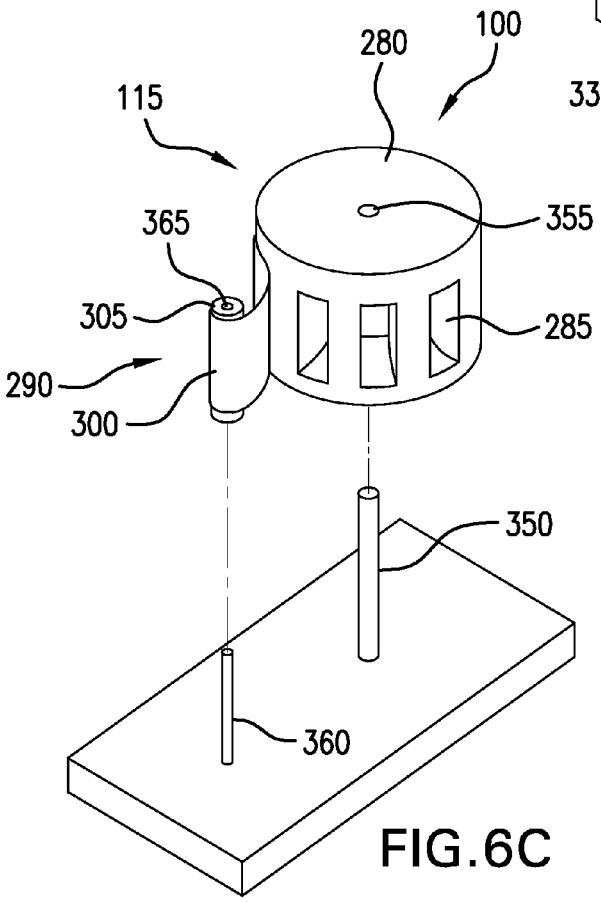

In another version, the moisture barrier 115 comprises a housing 280 having a plurality of compartments 285 that each contain a single dose or a portion of a single dose of an aerosolizable pharmaceutical formulation in a capsule 105, as shown in FIGS. 5A and 5B. The compartments 285 may be at least partially evacuated or moisture may be otherwise removed prior to or during insertion of one or more capsules 105 thereinto. The compartments 285 have an opening for accessing the compartment 285, and a cover member 290 covers the openings. In the version of Figure of FIG. 5A, the cover member 290 comprises a slidable plate 295 that may be slid to provide access to a compartment 285. The slidable plate 295 may ride in grooves or the like (not shown) in the housing 280. Around each opening on the top of the housing 280 is a seal 299, such as an o-ring type seal that engages the slidable plate 295 when the slidable plate 295 is positioned over a compartment 285 to prevent excessive moisture from penetrating into the compartment 285. Another version of a cover member 290 is shown in FIG. 5B. In this version, the cover member 290 comprises metal containing layer 300, such as a foil comprising aluminum, that sealingly covers the compartments 285. In one version, a spool 305 is provided so that the rotation of the spool 305 causes the metal-containing layer 300 to be removed from a compartment 285. FIGS. 6A, 6B, and 6C show rotary versions of a moisture barrier 115 comprises a housing 280 having a plurality of compartments 285 that each contain a single dose or a portion of a single dose of an aerosolizable pharmaceutical formulation in a capsule 105. In the version of FIG. 6A, the cover member 290 comprises a round or circular disc 310 having an opening 315. The disc 310 includes a bore 320 that may be received on a shaft 325 of the housing 280 so that the disc 310 may rotate relative to the housing 280 to align the opening 315 with a compartment 285. The seal 299 about the compartment 285 prevents moisture from reaching the compartments 285 before the opening 315 is in alignment. A ratchet or other locking mechanism may be provided to control the relative rotation between the disc 310 and the housing 280. In the version of FIG. 6B, the compartments 285 are provided on the edge of a circular housing 280, and the cover member 290 comprises a cylinder 330 having an opening 335 that may be aligned with the compartments 285. A post 340 receives an bore 345 in the housing 280 to provide the rotation between the housing 280 and the cover member 290, which may be controlled as discussed above. In the version of FIG. 6C, the compartments 285 are covered by the metal-containing layer 300, and a spool 305 is optionally provided to take up the metal-containing layer 300. The housing 280 and/or the spool 305 may be rotatable by having bores 355, 365 that may be received on respective posts 350, 360. In one version, a handle may be provided for rotating the spool 305 which in turn causes the body 280 to rotate.

Figure 7:
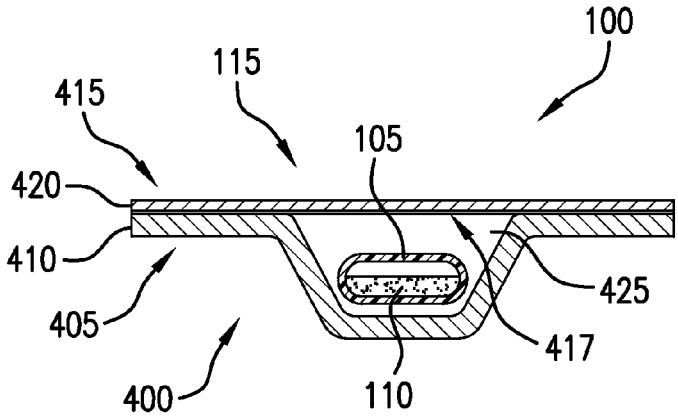
FIG. 7 is a schematic sectional side view of a version of a package comprising a multi-layered package.
Figure 8:
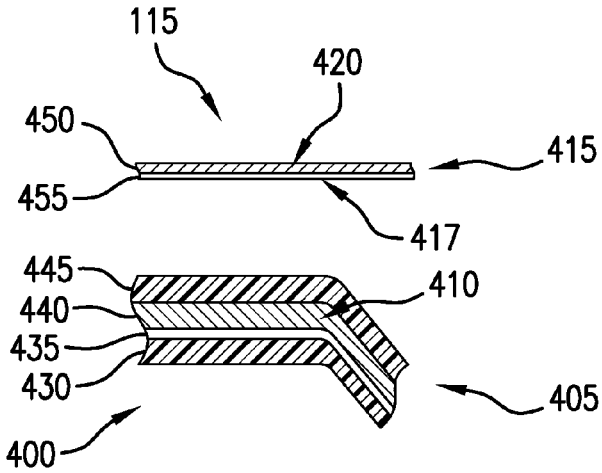
FIG. 8 is a schematic sectional side view of another version of a package comprising a multi-layered package.

In one version, the moisture barrier comprises a multi-layered package 400. In one particular version, the multi-layered package 400, such as a blister, surrounds a capsule 105 containing a pharmaceutical formulation that is susceptible to degradation and/or reduced aerosol performance when exposed to excessive amounts of moisture, such as a dry powder aerosolizable pharmaceutical formulation. The multi-layered package 400 may comprise one or more materials that provide improved moisture barrier properties. For example, the multi-layered package 400 may comprise one or more metals, such as aluminum or the like, and/or other moisture barrier materials. The moisture barrier may be provided below and above the pharmaceutical formulation to provide additional moisture protection. For example, as shown in the version of FIG. 7, the multi-layered package 400 may comprise a lower layer 405 comprising a metal containing layer 410 and an upper layer 415 comprising a metal containing layer 420. The metal containing layers 410, 420 may be sufficiently thick to substantially prevent a significant amount of moisture from passing therethrough. For example, the metal containing layers 410, 420 may be from about 10 μm to about 100 μm, and more preferably from about 20 μm to about 80 μm. The lower layer 405 and the upper layer 415 are sealed together by a layer of sealing material 417, such as a layer of lacquer that may be from about 1 μm to about 20 μm. Within a cavity 425 is a capsule 105 containing a pharmaceutical formulation, such as a pharmaceutical formulation in dry powder form that may be aerosolized. The lower layer 405 and/or the upper layer 415 of the multi-layered package 400 may optionally include additional materials that serve to improve the sealing or moldability of the layers. For example, FIG. 8 shows a particular version of a multi-layered package 400 useful in providing a moisture barrier package for a pharmaceutical formulation. In this version, the lower layer 405 comprises a first layer 430 comprising polymeric material, such as polyvinyl chloride, and having a thickness of about 60 μm, a second layer 435 comprising a polyamide, such as nylon, and having a thickness of about 25 μm, a third layer 440 comprising a metal, such as aluminum, and having a thickness of about 60 μm, and a fourth layer 445 comprising a polymeric material, such as polyvinyl chloride, and having a thickness of about 60 μm. The upper layer 415 comprises a first layer 450 comprising a metal, such as aluminum, and having a thickness of about 25 μm, and a second layer 455 comprising a sealing material, such as lacquer, and having a thickness of about 6 μm. The multi-layered package 400 comprising a lower layer 405 comprising a metal containing layer 410 and an upper layer 415 comprising a metal containing layer 420 also has the added benefit of protecting the mechanical integrity of the capsule 105. The metal containing layers provide sufficient rigidity to prevent damage from occurring to the capsule 105 during storage or transport of the capsule 105. As a result, when the capsule 105 is inserted into an aerosolization device, the chances of consistent aerosolization of the pharmaceutical formulation are increased.

Figure 9A:
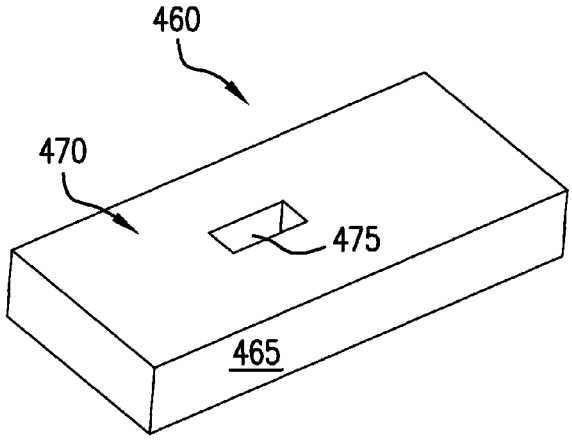
FIGS. 9A through 9C illustrate a process of sealing the multi-layered package of FIG. 7 or 8.
Figure 9B:
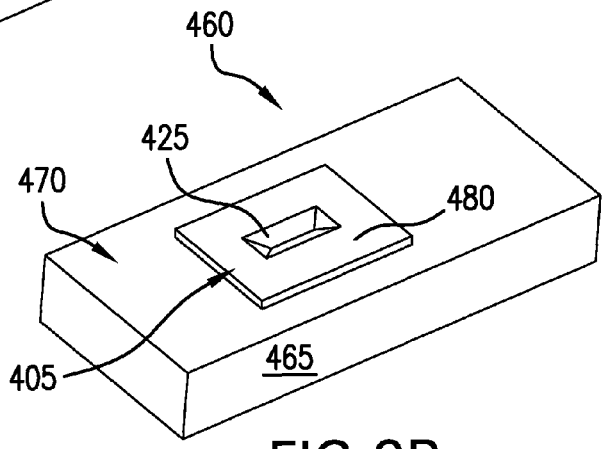
Figure 9C:
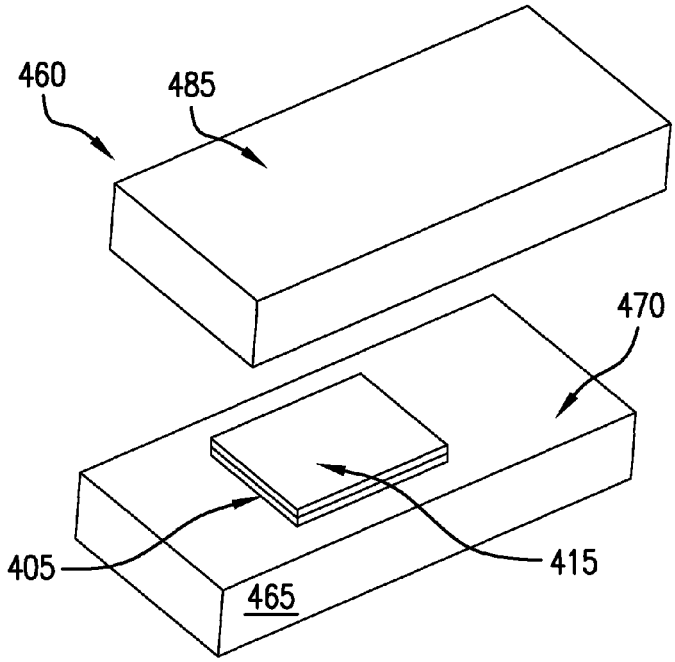

FIGS. 9A through 9C illustrate a method of sealing the capsule 105 within a multi-layered package 400. A sealing apparatus 460 comprises a first platform 465 which has a surface 470 which supports a multi-layered package that is to be sealed. The sealing apparatus 460 seals a plurality of layers to one another with the capsule 105 contained between the layers. As shown in FIG. 9B, The lower layer 405 of a multi-layered package is placed on the platform surface 470. The cavity 425 of in the lower layer 405 is positioned within a recess 475 in the surface 470 while a rim portion 480 rests on the surface 470. The cavity 425 may be formed on the platform 465 and/or the capsule 105 (not shown in FIG. 9B) may be inserted into the cavity 425 while the lower layer 405 is positioned on the surface 470. Alternatively, a lower layer 405 with a preformed cavity 425 prefilled with the capsule 105 may be positioned onto the surface 470. An upper layer 415 is then, or previously, positioned over the lower layer 130, as shown in FIG. 9C. When the layers are positioned on the first platform 465, a second platform 485 is lowered toward the first platform 465. The second platform may be heated so that it heats the upper layer 415. The heating and/or compression of the layers 405,415 seals the layers to one another and secures the capsule 105 containing the aerosolizable pharmaceutical formulation within the sealed multi-layered package 400.

Figure 10A:
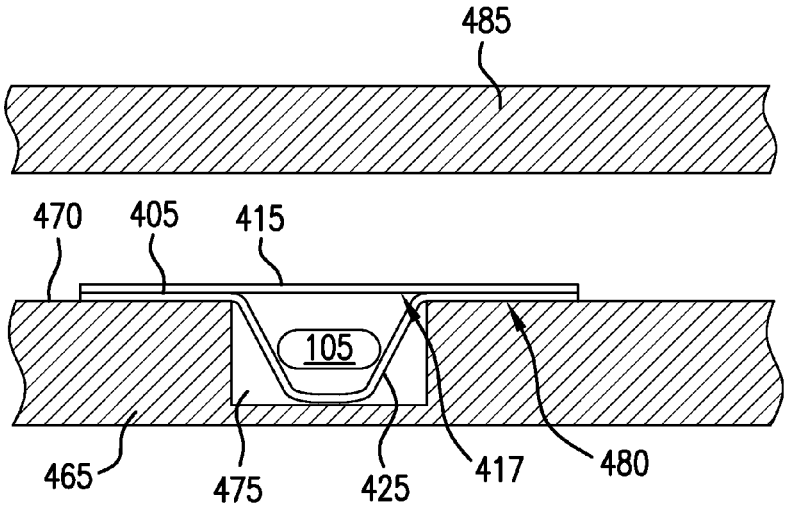
FIGS. 10A and 10B are schematic sectional side views of a sealing apparatus at different stages of a sealing process.
Figure 10B:
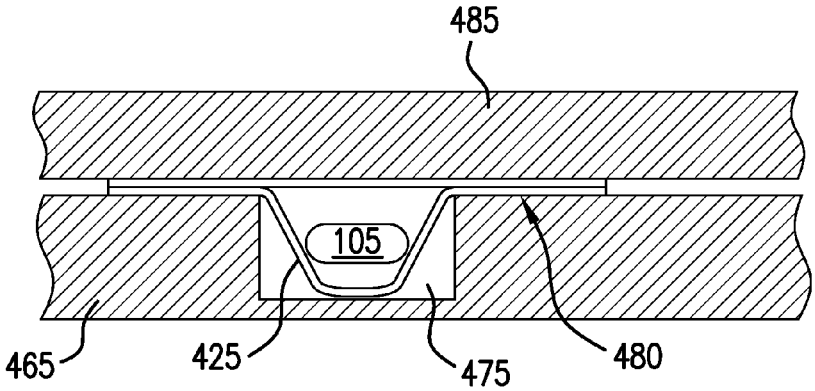

The sealing process is further illustrated in FIGS. 10A and 10B, which show cross-sectional views before and after the lowering of the second platform 485, respectively. In FIG. 10A, the lower layer 405 is positioned on the platform surface 470 with the cavity 425, which is filled with a capsule 105 containing the aerosolizable pharmaceutical formulation, positioned within the recess 475. Alternatively to the configuration shown, the recess 475 may be shaped to more closely resemble the contour of the cavity 425. The upper layer 415 is positioned over the lower layer 405. Between the upper layer 415 the lower layer 405 is a sealing material 417 that may cause a seal to be formed between the upper layer 415 and the lower layer 405 when heated and/or compressed. To seal the layers, the second platform 485 is heated and lowered onto the first platform 465 as discussed above and as shown in FIG. 10B.

The sealing material 417 is positioned between the upper layer 415 and the lower layer 405 and comprises a material that can seal the upper layer 415 to the lower layer 405 when heat and/or compression is applied to the sandwiched layers. For example, in one version, the sealing material comprises a layer of heat activated sealer, such as lacquer, or polymethyl methacrylate (PMMA), or the like. The heat activated sealer may be provided on the lower surface of the upper layer 415. When heated to a sufficient temperature, such as at least about 160° C., and often at least about 180° C., the heat activated sealer changes state so that when cooled, the upper layer 415 is sealed to the lower layer 405. Alternatively, the heat activated sealer may be provided on an upper surface of the lower layer 405 or may be a separate sheet positioned between the upper layer 415 and the lower layer 405. In another version, the heat activated sealer may be the material of the upper layer 415 and/or the lower layer 405. In this version, sufficient heat may be applied to melt the material between the layers so that the layers may be fused to one another upon cooling. Alternatively, the sealing material may comprise an adhesive or bonding material that does not require heat to activate.

Figure 11:
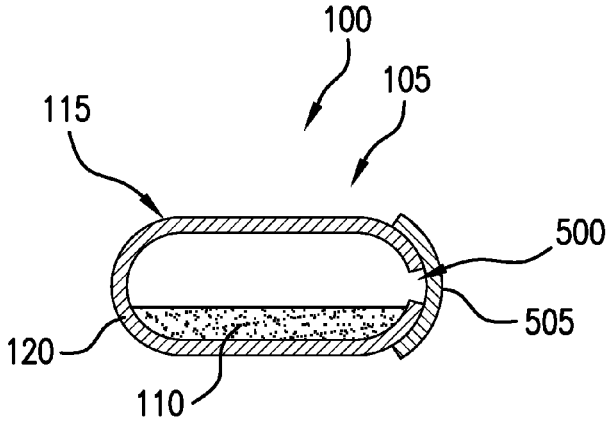
FIG. 11 is a schematic sectional side view of a version of a package comprising a capsule with a metal containing wall.
Figure 12A:
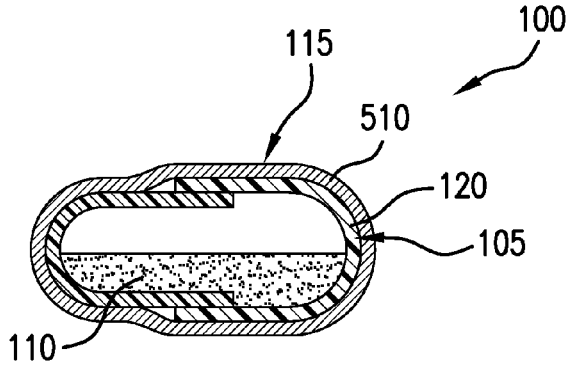
FIGS. 12A through 12C are schematic sectional side views of versions of packages having metal containing layers.
Figure 12B:
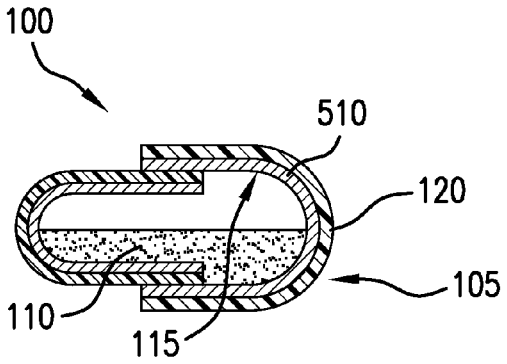
Figure 12C:
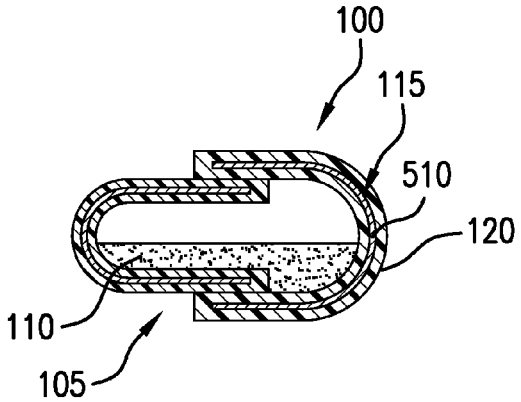

In another version, the moisture barrier 115 may be provided by the material of the capsule 105. For example, as shown in FIG. 11, the capsule 105 may have a wall 120 that comprises a metal, such as aluminum. In the version shown, an opening 500 is provided in the wall 120 to allow for the dispersion of the pharmaceutical formulation 110 during use. A metal-containing layer 505, such as a foil comprising aluminum, covers the opening 500. The metal-containing layer 505 may be heat sealed to the wall 120 and may optionally be provided with a tab by which the cover may be removed by a user prior to use. Alternatively or additionally, the moisture barrier 115 may be provided by a metal-containing layer 505 that is applied around, within, or on the interior of the wall 120 of a capsule 105. For example, FIG. 12A shows of a version of the invention where a metal-containing layer 510 is applied around a capsule that has been filled with an aerosolizable pharmaceutical formulation 110. The metal-containing layer 510, such as a foil comprising aluminum, may be heat shrunk onto the capsule 105 or may be otherwise applied. Tabs may be included to allow the foil to be removed from the capsule 105. Alternatively, the capsule 105 with the foil overwrapping may be inserted into an aerosolization device and the pharmaceutical formulation 110 may be accessed by the capsule opening mechanism utilized by the aerosolization device. In other versions, a metal containing layer 510 may be provided on the interior of the capsule wall 120, as shown in FIG. 12B, or may be within the capsule wall 120, as shown in FIG. 12C.

Figure 13:
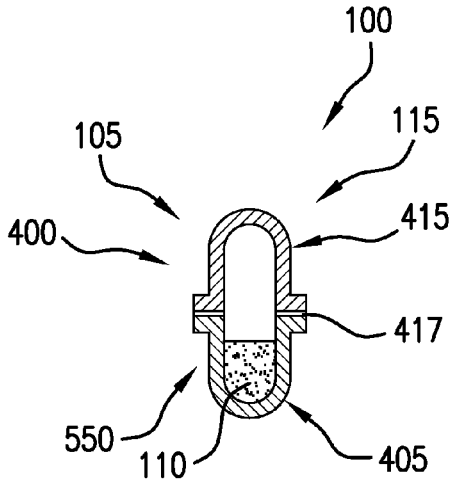
FIG. 13 is a schematic sectional side view of a package comprising a capsule shaped multi-layered package.
Figure 14:
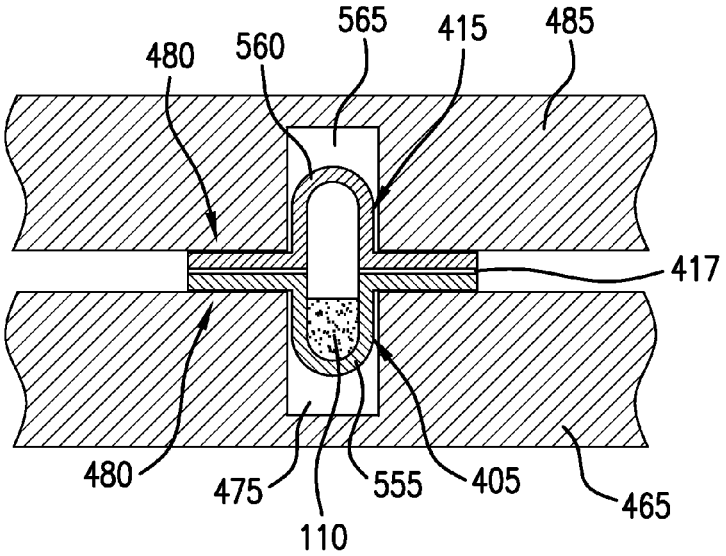
FIG. 14 is a schematic sectional side view of a sealing apparatus for sealing the package of FIG. 13.

In another version, as shown in FIG. 13, a multi-layered package 400 is formed into a capsule shaped multi-layered package 550. In this version, the capsule shaped multi-layered package 550 may be filled with an aerosolizable pharmaceutical formulation 110 and may serve and the capsule 105. For example, the capsule shaped multi-layered package 550 may be placed in an aerosolization device and used by a user. The materials of the upper layer 415 and the lower layer 405 may be as discussed above. For example, the layers may comprise a metal or other moisture barrier material in order to provide sufficient moisture protection for the aerosolizable pharmaceutical formulation within the capsule shaped multi-layered package 550. A shown in FIG. 14, the capsule shaped multi-layered package 550 may be formed in a manner similar to the sealing process described above in connection with FIGS. 9 and 10. In this version, the recess 475 in the first platform 465 is sized to accommodate the semi-capsule shaped cavity 555 formed in the lower layer 405. In addition, a recess 565 is provided in the second platform 485 to accommodate a semi-capsule shaped cavity 560 formed in the upper layer 415. The platforms 465, 485 compress to heat seal the upper layer 485 to the lower layer 465, as discussed above, along the rim portions 480. After sealing, the rim portion 480 may be trimmed to create a smoother profile.

In one version, the package 100 is adapted to contain a dry powder pharmaceutical formulation 110, as discussed above. The capsule 105 may contain the pharmaceutical formulation in a form where it may be aerosolized for inhalation by the user. For example, when in a powdered form, the powder may be initially stored in the capsule 105, as described in U.S. Pat. No. 4,995,385, U.S. Pat. No. 3,991,761, U.S. Pat. No. 6,230,707, and PCT Publication WO 97/27892, the capsule being openable before, during, or after insertion of the capsule into an aerosolization device. The powder may be aerosolized by an active element, such as compressed air, as described in U.S. Pat. No. 5,458,135, U.S. Pat. No. 5,785,049, and U.S. Pat. No. 6,257,233, or propellant, as described in U.S. patent application Ser. No. 09/556,262, filed on Apr. 24, 2000, and entitled "Aerosolization Apparatus and Methods", and in PCT Publication WO 00/72904. Alternatively the powder may be aerosolized in response to a user's inhalation, as described for example in the aforementioned U.S. patent application Ser. No. 09/583,312 and U.S. Pat. No. 4,995,385. All of the above references being incorporated herein by reference in their entireties.

The package 100 of the present invention has been found to be particularly effective when used to store a capsule that is to be used in an aerosolization device that includes a puncturing element, such as the device described in U.S. Pat. No. 4,995,385 and similar devices. The improved moisture protection provided by the package 100 allows for better deagglomeration during the aerosolization process, which results in more finely divided particles for inhalation by the user. In addition, the improved moisture protection prevents the capsule material from becoming brittle. This brittle prevention allows the puncturing element to more efficiently and consistently create one or more openings into the capsule during use. Without the moisture protection, the capsule may become brittle and may shatter, create capsule particles, and/or have less reproducible openings when punctured. Accordingly, the moisture barrier afforded by the present package 100 provides numerous aerosolization benefits.

In a preferred version, the invention provides a capsule 105 that may be used with a system and method for aerosolizing a pharmaceutical formulation and delivering the pharmaceutical formulation to the lungs of the user. The pharmaceutical formulation may comprise powdered medicaments, liquid solutions or suspensions, and the like, and may include an active agent.

The active agent described herein includes an agent, drug, compound, composition of matter or mixture thereof which provides some pharmacologic, often beneficial, effect. This includes foods, food supplements, nutrients, drugs, vaccines, vitamins, and other beneficial agents. As used herein, the terms further include any physiologically or pharmacologically active substance that produces a localized or systemic effect in a patient. An active agent for incorporation in the pharmaceutical formulation described herein may be an inorganic or an organic compound, including, without limitation, drugs which act on: the peripheral nerves, adrenergic receptors, cholinergic receptors, the skeletal muscles, the cardiovascular system, smooth muscles, the blood circulatory system, synoptic sites, neuroeffector junctional sites, endocrine and hormone systems, the immunological system, the reproductive system, the skeletal system, autacoid systems, the alimentary and excretory systems, the histamine system, and the central nervous system. Suitable active agents may be selected from, for example, hypnotics and sedatives, psychic energizers, tranquilizers, respiratory drugs, anticonvulsants, muscle relaxants, antiparkinson agents (dopamine antagnonists), analgesics, anti-inflammatories, antianxiety drugs (anxiolytics), appetite suppressants, antimigraine agents, muscle contractants, anti-infectives (antibiotics, antivirals, antifungals, vaccines) antiarthritics, antimalarials, antiemetics, anepileptics, bronchodilators, cytokines, growth factors, anti-cancer agents, antithrombotic agents, antihypertensives, cardiovascular drugs, antiarrhythmics, antioxicants, antiasthma agents, hormonal agents including contraceptives, sympathomimetics, diuretics, lipid regulating agents, antiandrogenic agents, antiparasitics, anticoagulants, neoplastics, antineoplastics, hypoglycemics, nutritional agents and supplements, growth supplements, antienteritis agents, vaccines, antibodies, diagnostic agents, and contrasting agents. The active agent, when administered by inhalation, may act locally or systemically.

The active agent may fall into one of a number of structural classes, including but not limited to small molecules, peptides, polypeptides, proteins, polysaccharides, steroids, proteins capable of eliciting physiological effects, nucleotides, oligonucleotides, polynucleotides, fats, electrolytes, and the like.

Examples of active agents suitable for use in this invention include but are not limited to one or more of calcitonin, erythropoietin (EPO), Factor VIII, Factor IX, ceredase, cerezyme, cyclosporin, granulocyte colony stimulating factor (GCSF), thrombopoietin (TPO), alpha-1 proteinase inhibitor, elcatonin, granulocyte macrophage colony stimulating factor (GMCSF), growth hormone, human growth hormone (HGH), growth hormone releasing hormone (GHRH), heparin, low molecular weight heparin (LMWH), interferon alpha, interferon beta, interferon gamma, interleukin-1 receptor, interleukin-2, interleukin-1 receptor antagonist, interleukin-3, interleukin-4, interleukin-6, luteinizing hormone releasing hormone (LHRH), factor IX, insulin, pro-insulin, insulin analogues (e.g., mono-acylated insulin as described in U.S. Pat. No. 5,922,675, which is incorporated herein by reference in its entirety), amylin, C-peptide, somatostatin, somatostatin analogs including octreotide, vasopressin, follicle stimulating hormone (FSH), insulin-like growth factor (IGF), insulintropin, macrophage colony stimulating factor (M-CSF), nerve growth factor (NGF), tissue growth factors, keratinocyte growth factor (KGF), glial growth factor (GGF), tumor necrosis factor (TNF), endothelial growth factors, parathyroid hormone (PTH), glucagon-like peptide thymosin alpha 1, IIb/IIIa inhibitor, alpha-1 antitrypsin, phosphodiesterase (PDE) compounds, VLA-4 inhibitors, bisphosponates, respiratory syncytial virus antibody, cystic fibrosis transmembrane regulator (CFTR) gene, deoxyreibonuclease (Dnase), bactericidal/permeability increasing protein (BPI), anti-CMV antibody, 13-cis retinoic acid, macrolides such as erythromycin, oleandomycin, troleandomycin, roxithromycin, clarithromycin, davercin, azithromycin, flurithromycin, dirithromycin, josamycin, spiromycin, midecamycin, leucomycin, miocamycin, rokitamycin, andazithromycin, and swinolide A; fluoroquinolones such as ciprofloxacin, ofloxacin, levofloxacin, trovafloxacin, alatrofloxacin, moxifloxicin, norfloxacin, enoxacin, grepafloxacin, gatifloxacin, lomefloxacin, sparfloxacin, temafloxacin, pefloxacin, amifloxacin, fleroxacin, tosufloxacin, prulifloxacin, irloxacin, pazufloxacin, clinafloxacin, and sitafloxacin, aminoglycosides such as gentamicin, netilmicin, paramecin, tobramycin, amikacin, kanamycin, neomycin, and streptomycin, vancomycin, teicoplanin, rampolanin, mideplanin, colistin, daptomycin, gramicidin, colistimethate, polymixins such as polymixin B, capreomycin, bacitracin, penems; penicillins including penicllinase-sensitive agents like penicillin G, penicillin V, penicillinase-resistant agents like methicillin, oxacillin, cloxacillin, dicloxacillin, floxacillin, nafcillin; gram negative microorganism active agents like ampicillin, amoxicillin, and hetacillin, cillin, and galampicillin; antipseudomonal penicillins like carbenicillin, ticarcillin, azlocillin, mezlocillin, and piperacillin; cephalosporins like cefpodoxime, cefprozil, ceftbuten, ceftizoxime, ceftriaxone, cephalothin, cephapirin, cephalexin, cephradrine, cefoxitin, cefamandole, cefazolin, cephaloridine, cefaclor, cefadroxil, cephaloglycin, cefuroxime, ceforanide, cefotaxime, cefatrizine, cephacetrile, cefepime, cefixime, cefonicid, cefoperazone, cefotetan, cefmetazole, ceftazidime, loracarbef, and moxalactam, monobactams like aztreonam; and carbapenems such as imipenem, meropenem, pentamidine isethiouate, albuterol sulfate, lidocaine, metaproterenol sulfate, beclomethasone diprepionate, triamcinolone acetamide, budesonide acetonide, fluticasone, ipratropium bromide, flunisolide, cromolyn sodium, ergotamine tartrate and where applicable, analogues, agonists, antagonists, inhibitors, and pharmaceutically acceptable salt forms of the above. In reference to peptides and proteins, the invention is intended to encompass synthetic, native, glycosylated, unglycosylated, pegylated forms, and biologically active fragments and analogs thereof.

Active agents for use in the invention further include nucleic acids, as bare nucleic acid molecules, vectors, associated viral particles, plasmid DNA or RNA or other nucleic acid constructions of a type suitable for transfection or transformation of cells, i.e., suitable for gene therapy including antisense. Further, an active agent may comprise live attenuated or killed viruses suitable for use as vaccines. Other useful drugs include those listed within the Physician's Desk Reference (most recent edition).

The amount of active agent in the pharmaceutical formulation will be that amount necessary to deliver a therapeutically effective amount of the active agent per unit dose to achieve the desired result. In practice, this will vary widely depending upon the particular agent, its activity, the severity of the condition to be treated, the patient population, dosing requirements, and the desired therapeutic effect. The composition will generally contain anywhere from about 1% by weight to about 99% by weight active agent, typically from about 2% to about 95% by weight active agent, and more typically from about 5% to 85% by weight active agent, and will also depend upon the relative amounts of additives contained in the composition. The compositions of the invention are particularly useful for active agents that are delivered in doses of from 0.001 mg/day to 100 mg/day, preferably in doses from 0.01 mg/day to 75 mg/day, and more preferably in doses from 0.10 mg/day to 50 mg/day. It is to be understood that more than one active agent may be incorporated into the formulations described herein and that the use of the term "agent" in no way excludes the use of two or more such agents.

The pharmaceutical formulation may comprise a pharmaceutically acceptable excipient or carrier which may be taken into the lungs with no significant adverse toxicological effects to the subject, and particularly to the lungs of the subject. In addition to the active agent, a pharmaceutical formulation may optionally include one or more pharmaceutical excipients which are suitable for pulmonary administration. These excipients, if present, are generally present in the composition in amounts ranging from about 0.01% to about 95% percent by weight, preferably from about 0.5 to about 80%, and more preferably from about 1 to about 60% by weight. Preferably, such excipients will, in part, serve to further improve the features of the active agent composition, for example by providing more efficient and reproducible delivery of the active agent, improving the handling characteristics of powders, such as flowability and consistency, and/or facilitating manufacturing and filling of unit dosage forms. In particular, excipient materials can often function to further improve the physical and chemical stability of the active agent, minimize the residual moisture content and hinder moisture uptake, and to enhance particle size, degree of aggregation, particle surface properties, such as rugosity, ease of inhalation, and the targeting of particles to the lung. One or more excipients may also be provided to serve as bulking agents when it is desired to reduce the concentration of active agent in the formulation.

Pharmaceutical excipients and additives useful in the present pharmaceutical formulation include but are not limited to amino acids, peptides, proteins, non-biological polymers, biological polymers, carbohydrates, such as sugars, derivatized sugars such as alditols, aldonic acids, esterified sugars, and sugar polymers, which may be present singly or in combination. Suitable excipients are those provided in WO 96/32096, which is incorporated herein by reference in its entirety. The excipient may have a glass transition temperature (Tg) above about 35° C., preferably above about 40° C., more preferably above 45° C., most preferably above about 55° C.

Exemplary protein excipients include albumins such as human serum albumin (HSA), recombinant human albumin (rHA), gelatin, casein, hemoglobin, and the like. Suitable amino acids (outside of the dileucyl-peptides of the invention), which may also function in a buffering capacity, include alanine, glycine, arginine, betaine, histidine, glutamic acid, aspartic acid, cysteine, lysine, leucine, isoleucine, valine, methionine, phenylalanine, aspartame, tyrosine, tryptophan, and the like. Preferred are amino acids and polypeptides that function as dispersing agents. Amino acids falling into this category include hydrophobic amino acids such as leucine, valine, isoleucine, tryptophan, alanine, methionine, phenylalanine, tyrosine, histidine, and proline. Dispersibility—enhancing peptide excipients include dimers, trimers, tetramers, and pentamers comprising one or more hydrophobic amino acid components such as those described above.

Carbohydrate excipients suitable for use in the invention include, for example, monosaccharides such as fructose, maltose, galactose, glucose, D-mannose, sorbose, and the like; disaccharides, such as lactose, sucrose, trehalose, cellobiose, and the like; polysaccharides, such as raffinose, melezitose, maltodextrins, dextrans, starches, and the like; and alditols, such as mannitol, xylitol, maltitol, lactitol, xylitol sorbitol (glucitol), pyranosyl sorbitol, myoinositol and the like.

The pharmaceutical formulation may also include a buffer or a pH adjusting agent, typically a salt prepared from an organic acid or base. Representative buffers include organic acid salts of citric acid, ascorbic acid, gluconic acid, carbonic acid, tartaric acid, succinic acid, acetic acid, or phthalic acid, Tris, tromethamine hydrochloride, or phosphate buffers.

The pharmaceutical formulation may also include polymeric excipients/additives, e.g., polyvinylpyrrolidones, derivatized celluloses such as hydroxymethylcellulose, hydroxyethylcellulose, and hydroxypropylmethylcellulose, Ficolls (a polymeric sugar), hydroxyethylstarch, dextrates (e.g., cyclodextrins, such as 2-hydroxypropyl-β-cyclodextrin and sulfobutylether-β-cyclodextrin), polyethylene glycols, and pectin.

The pharmaceutical formulation may further include flavoring agents, taste-masking agents, inorganic salts (for example sodium chloride), antimicrobial agents (for example benzalkonium chloride), sweeteners, antioxidants, antistatic agents, surfactants (for example polysorbates such as "TWEEN 20" and "TWEEN 80"), sorbitan esters, lipids (for example phospholipids such as lecithin and other phosphatidylcholines, phosphatidylethanolamines), fatty acids and fatty esters, steroids (for example cholesterol), and chelating agents (for example EDTA, zinc and other such suitable cations). Other pharmaceutical excipients and/or additives suitable for use in the compositions according to the invention are listed in "Remington: The Science & Practice of Pharmacy", $19^{th}$ ed., Williams & Williams, (1995), and in the "Physician's Desk Reference", $52^{nd}$ ed., Medical Economics, Montvale, N.J. (1998), both of which are incorporated herein by reference in their entireties.

"Mass median diameter" or "MMD" is a measure of mean particle size, since the powders of the invention are generally polydisperse (i.e., consist of a range of particle sizes). MMD values as reported herein are determined by centrifugal sedimentation, although any number of commonly employed techniques can be used for measuring mean particle size. "Mass median aerodynamic diameter" or "MMAD" is a measure of the aerodynamic size of a dispersed particle. The aerodynamic diameter is used to describe an aerosolized powder in terms of its settling behavior, and is the diameter of a unit density sphere having the same settling velocity, generally in air, as the particle. The aerodynamic diameter encompasses particle shape, density and physical size of a particle. As used herein, MMAD refers to the midpoint or median of the aerodynamic particle size distribution of an aerosolized powder determined by cascade impaction.

In one version, the powdered formulation for use in the present invention includes a dry powder having a particle size selected to permit penetration into the alveoli of the lungs, that is, preferably 10 μm mass median diameter (MMD), preferably less than 7.5 μm, and most preferably less than 5 μm, and usually being in the range of 0.1 μm to 5 μm in diameter. The delivered dose efficiency (DDE) of these powders may be greater than 30%, more preferably greater than 40%, more preferably greater than 50% and most preferably greater than 60% and the aerosol particle size distribution is about 1.0-5.0 μm mass median aerodynamic diameter (MMAD), usually 1.5-4.5 μm MMAD and preferably 1.5-4.0 μm MMAD. These dry powders have a moisture content below about 10% by weight, usually below about 5% by weight, and preferably below about 3% by weight. Such powders are described in WO 95/24183, WO 96/32149, WO 99/16419, and WO 99/16422, all of which are all incorporated herein by reference in their entireties.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the relative positions of the elements in the expedients for carrying out the relative movements may be changed. Also, the various features of the versions herein can be combined in various ways to provide additional versions of the present invention. Furthermore, certain terminology has been used for the purposes of descriptive clarity, and not to limit the present invention. For example, the use of the terms "upper" and "lower" may be reversed in the specification. Therefore, the appended claims should not be limited to the description of the preferred versions contained herein and should include all such alterations, permutations, and equivalents as fall within the true spirit and scope of the present invention.

What is claimed is:

1. A package comprising:

a capsule containing an aerosolizable pharmaceutical formulation comprising a powder having a particle size distribution of about 1.0-5.0 μm mass median aerodynamic diameter and wherein the particles comprise an active agent and an excipient, wherein the active agent comprises an aminoglycoside or a fluoroquinolone; and a moisture barrier around the capsule, the moisture barrier comprising a material that is resistant to moisture passage, wherein the moisture barrier comprises a multi-layered package comprising an upper layer comprising a metal and a lower layer comprising a metal, the lower layer having a cavity formed therein for removably holding the capsule, and wherein at least one of the layers further comprises a polymeric material, whereby the moisture barrier reduces the amount of moisture in contact with the aerosolizable pharmaceutical formulation so that the aerosolizable pharmaceutical formulation may be aerosolized when the capsule is opened and inserted into an aerosolization device.

2. A package according to claim 1 wherein the capsule comprises HPMC.

3. A package according to claim 1 wherein the moisture barrier comprises aluminum.

4. A package according to claim 1 wherein both layers comprise aluminum.

5. A package according to claim 1 wherein the package contains a single dose of the aerosolizable pharmaceutical formulation.

6. A package according to claim 1 wherein the active agent comprises tobramycin.

7. A package according to claim 1 wherein the active agent comprises ciprofloxacin.

8. A method of storing an aerosolizable pharmaceutical formulation, the method comprising:

containing an aerosolizable pharmaceutical formulation comprising a powder having a particle size distribution of about 1.0-5.0 μm mass median aerodynamic diameter within a capsule, wherein the particles comprise an active agent and an excipient and wherein the active agent comprises an aminoglycoside or a fluoroquinolone; and surrounding the capsule with a moisture barrier to reduce the amount of moisture in contact with the aerosolizable pharmaceutical formulation so that the aerosolizable pharmaceutical formulation may be aerosolized when the capsule is opened, wherein the step of surrounding comprises sealing an upper layer of a multi-layer package to a lower layer of a multi-layer package to removably contain the capsule within a cavity formed in the lower layer, wherein the upper layer and the lower layer each comprise a metal, and wherein at least one of the layers comprises a polymeric material.

9. A method according to claim 8 wherein the upper layer and the lower layer each comprise aluminum.

10. A method according to claim 8 wherein the method comprises storing a single dose of the aerosolizable pharmaceutical formulation.

11. A method according to claim 8 wherein the active agent comprises tobramycin.

12. A method according to claim 8 wherein the active agent comprises ciprofloxacin.

13. A package comprising:

a capsule containing an aerosolizable pharmaceutical formulation comprising a powder having a particle size distribution of about 1.0-5.0 μm mass median aerodynamic diameter, wherein particles comprise an active agent and an excipient, wherein the excipient comprises a phospholipid; and a moisture barrier around the capsule, the moisture barrier comprising a material that is resistant to moisture passage, wherein the moisture barrier comprises a multi-layered package comprising an upper layer comprising a metal and a lower layer comprising a metal, the lower layer having a cavity formed therein for removably holding the capsule, wherein the upper layer is substantially flat and wherein a sealing material is positioned between the upper layer and the lower layer to seal the layers together, whereby the moisture barrier reduces the amount of moisture in contact with the aerosolizable pharmaceutical formulation so that the aerosolizable pharmaceutical formulation may be aerosolized when the capsule is opened and inserted into an aerosolization device.

14. A package according to claim 13 wherein the active agent comprises tobramycin.

15. A package according to claim 13 wherein the active agent comprises ciprofloxacin.

16. A package comprising:

a capsule containing an aerosolizable pharmaceutical formulation comprising a powder having a particle size distribution of about 1.0-5.0 μm mass median aerodynamic diameter; and a multi-layered package around the capsule, the multi-layered package comprising an upper layer and a lower layer, wherein the upper layer and the lower layer each comprise a metal layer, wherein the upper layer metal layer and the lower layer metal layer have different thicknesses and wherein the lower layer comprises a layer comprising polyvinyl chloride and a layer comprising a polyamide, whereby the multi-layered package reduces the amount of moisture in contact with the aerosolizable pharmaceutical formulation so that the aerosolizable pharmaceutical formulation may be aerosolized when the capsule is removed from the multi-layered package, opened, and inserted into an aerosolization device.

17. A package according to claim 16 wherein the active agent comprises tobramycin.

18. A package according to claim 16 wherein the active agent comprises ciprofloxacin.

19. A package according to claim 16 wherein the excipient comprises a phospholipid.

* * * * *